US007427214B2

(12) United States Patent
Liao et al.

(10) Patent No.: US 7,427,214 B2
(45) Date of Patent: Sep. 23, 2008

(54) COMPATIBLE CONNECTOR FOR FIRST AND SECOND JOINTS HAVING DIFFERENT PIN QUANTITIES

(75) Inventors: Yu-Jing Liao, Tao Yuan (TW); Yao-Chung Lin, Tao Yuan (TW); Tsung-Ying Tsai, Tao Yuan (TW); Dennis Chen, Tao Yuan (TW)

(73) Assignee: HTC Corporation, Taoyuan County (TW)

( * ) Notice: Subject to any disclaimer, the term of this patent is extended or adjusted under 35 U.S.C. 154(b) by 0 days.

(21) Appl. No.: 11/672,655

(22) Filed: Feb. 8, 2007

(65) Prior Publication Data

US 2007/0218762 A1 Sep. 20, 2007

(30) Foreign Application Priority Data

Mar. 20, 2006 (TW) ..... 95109410 A

(51) Int. Cl.
*H01R 13/648* (2006.01)

(52) U.S. Cl. ..... 439/607; 439/610

(58) Field of Classification Search ..... 439/607
See application file for complete search history.

(56) References Cited

U.S. PATENT DOCUMENTS

| | | | | |
|---|---|---|---|---|
| 6,299,487 | B1 * | 10/2001 | Lopata et al. | 439/610 |
| 6,315,608 | B1 * | 11/2001 | Lopata et al. | 439/607 |
| 6,447,311 | B1 * | 9/2002 | Hu et al. | 439/108 |
| D465,457 | S * | 11/2002 | Hu et al. | D13/147 |
| 7,128,608 | B1 * | 10/2006 | Chen | 439/607 |
| 7,128,617 | B2 * | 10/2006 | Wang et al. | 439/660 |
| 2007/0049115 | A1 * | 3/2007 | Igarashi et al. | 439/607 |
| 2007/0049119 | A1 * | 3/2007 | Fujimoto et al. | 439/610 |

* cited by examiner

*Primary Examiner*—Hae Moon Hyeon
(74) *Attorney, Agent, or Firm*—J.C. Patents

(57) ABSTRACT

A compatible connector for first and second joints having different pin quantities is disclosed. The connector includes a base, at least one first pin, and at least one second pin. The base includes a first connecting surface and a second connecting surface. The first pins are disposed on the first connecting surface and the quantity of the first pins is the same as the pin quantity of the first joint. In addition, the second pins are disposed on the second connecting surface and the total quantity of the second pins and the first pins is the same as the pin quantity of the second joint.

9 Claims, 6 Drawing Sheets

COMPATIBLE CONNECTOR FOR FIRST AND SECOND JOINTS HAVING DIFFERENT PIN QUANTITIES

CROSS-REFERENCE TO RELATED APPLICATION

This application claims the priority benefit of Taiwan application serial no. 95109410, filed Mar. 20, 2006. All disclosure of the Taiwan application is incorporated herein by reference.

BACKGROUND OF THE INVENTION

1. Field of the Invention

The present invention relates to a connector. More particularly, the present invention relates to a compatible connector for a first and a second joint having different pin quantities.

2. Description of Related Art

Simple peripheral devices, such as earphones, speakers, etc., are usually distinguished by different connectors for transmitting different data. The typical interface (or terminal) of a connector includes AV (Audio Video) joint, S-Video joint, USB joint, iLINK joint, earphone joint, and microphone joint etc. As to those hand-held devices, such as mobile phone, personal digital assistant (PDA), smart phone, player, game machine, or notebook PC, which are required to be light, thin, short, compact, and small, having connectors of various specs will increase not only the manufacturing cost but also the volumes thereof.

Universal serial bus (referred to as USB thereinafter) is currently broadly used as the interface for data transmission between a peripheral device and a host, and which is also a universal interface for transmitting data by using differential transmission technology. When a peripheral device is connected to a host through a USB transmission cord, the newly added hardware can be automatically detected through the USB terminal, and a suitable driving program for driving the peripheral device is searched for. Typical USB interfaces include 5-pin MINI A type male joint/female joint, 5-pin MINI B type male/female joint, and MINI AB female joint which is compatible to both MINI A and MINI B male joints.

Refer to FIG. 1, which illustrates that a plurality of USB pins 110 are arranged in parallel within a conventional MINI AB connector 100. It should be noted that since the quantity of the USB pins 110 is only 5, the connector 100 is only suitable for MINI A or MINI B connector (referring to FIG. 2 and FIG. 3), and the function thereof is limited. If the pin quantity of a peripheral device is different from the quantity of the USB pins 110, different connectors and transmission cords have to be installed to the host, accordingly, the manufacturing cost of the hand-held device and the volume thereof are increased.

SUMMARY OF THE INVENTION

Accordingly, the present invention is directed to provide a compatible connector for a first and a second joint having different pin quantities, counts, amounts or numbers to improve compatibility between devices.

The present invention provides a compatible connector for a first and a second joint having different pin quantities. The connector includes a base, at least a first pin, and at least a second pin. The base includes a first connecting surface and a second connecting surface. The first pins are disposed on the first connecting surface and the quantity of the first pins is the same as the pin quantity of the first joint. The second pins are disposed on the second connecting surface and the total quantity of the first pins and the second pins is the same as the pin quantity of the second joint.

According to an embodiment of the present invention, the foregoing base includes a convex part and a concave part for accommodating the convex part, wherein the first connecting surface and the second connecting surface are respectively disposed on two opposite surfaces of the convex part.

According to an embodiment of the present invention, a slot is disposed between the foregoing convex part and concave part for accommodating the first joint and the second joint.

According to an embodiment of the present invention, the foregoing first joint includes a joint which complies with MIN A or MINI B USB specification.

According to an embodiment of the present invention, the foregoing second joint includes an 11-pin joint complying with USB specification.

According to an embodiment of the present invention, the quantity of the first pins includes the quantity of the pins which comply with MINI A or MINI B USB specification.

According to an embodiment of the present invention, the total quantity of the second and the first pins is 11. The total quantity of the first pins is 5. The total quantity of the second pins is 6. Besides, the total pin quantity of the second joint is greater than the total pin quantity of the first joint.

According to an embodiment of the present invention, the foregoing second pins may include at least one identification pin, at least one audio pin, and at least one ground pin.

The present invention provides a compatible connector for a first and a second joint having different pin quantities. The connector includes at least a first connecting surface and a second connecting surface. The first connecting surface is a disposed with at least a first pin, and the quantity of the first pins is the same as the pin quantity of the first joint. The second connecting surface is disposed with at least a second pin, and the total quantity of the second pins and the first pins is the same as the pin quantity of the second joint.

According to an embodiment of the present invention, the foregoing first and second connecting surfaces are stacked on two opposite surfaces of the connector.

According to an embodiment of the present invention, the foregoing first and second connecting surfaces are accommodated in a base.

According to an embodiment of the present invention, the total quantity of the foregoing second pins and first pins is 11. The total quantity of the first pins is 5. The total quantity of the second pins is 6. Besides, the total pin quantity of the second joint is greater than the total pin quantity of the first joint.

In the present invention, a connector structure compatible to typical MINI A and MINI B USB interfaces is adopted and a set of independent functional pins are added to the original connector structure so that external devices having different pin quantities can share the highly compatible connector structure. Accordingly, the connector in the present invention can meet function expansion requirement and furthermore, can accomplish the purpose of connector sharing in product design.

In order to make the aforementioned and other objects, features and advantages of the present invention comprehensible, a preferred embodiment accompanied with figures is described in detail below.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
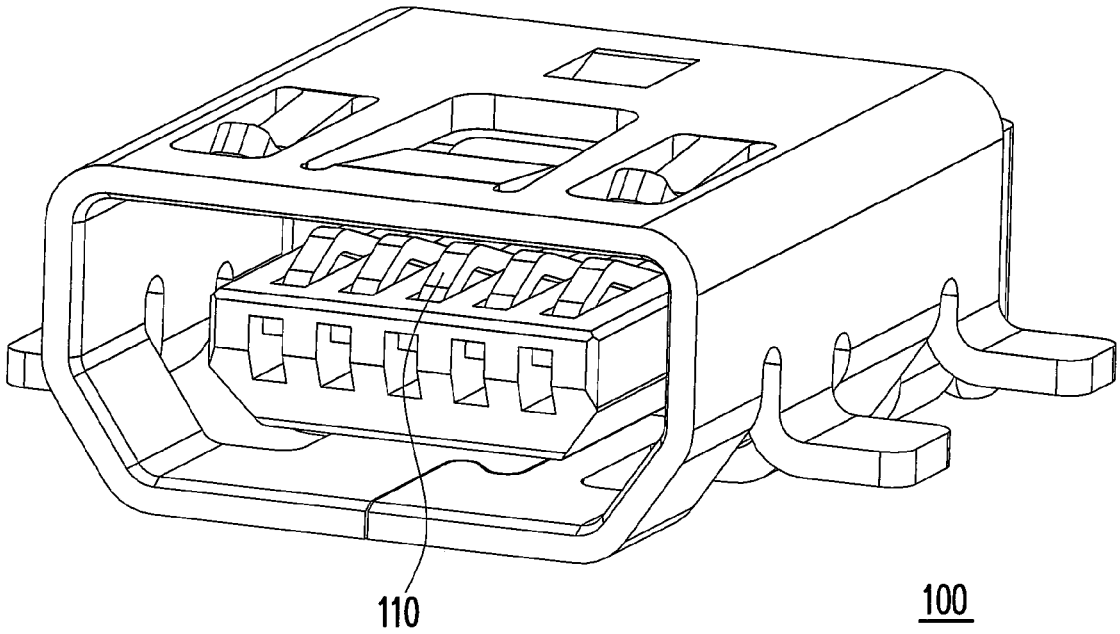
FIG. 1 (PRIOR ART)
FIG. 1 is a diagram illustrating that a plurality of USB pins are arranged in parallel within a conventional MINI AB connector.
Figure 2:
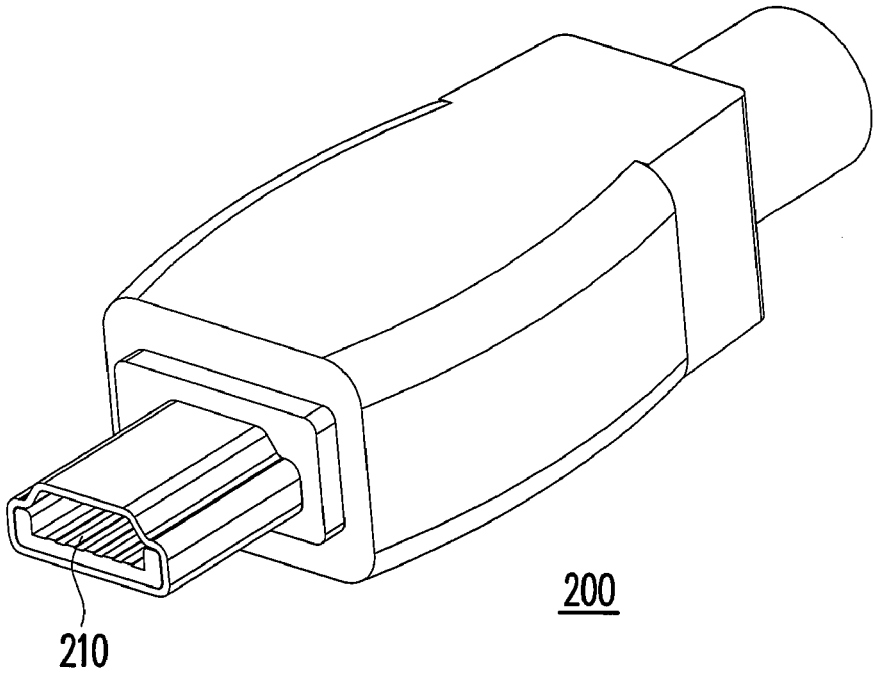
FIG. 2 (PRIOR ART)
FIG. 2 and FIG. 3 respectively illustrate conventional MINI A and MINI B male joint connectors.
Figure 3:
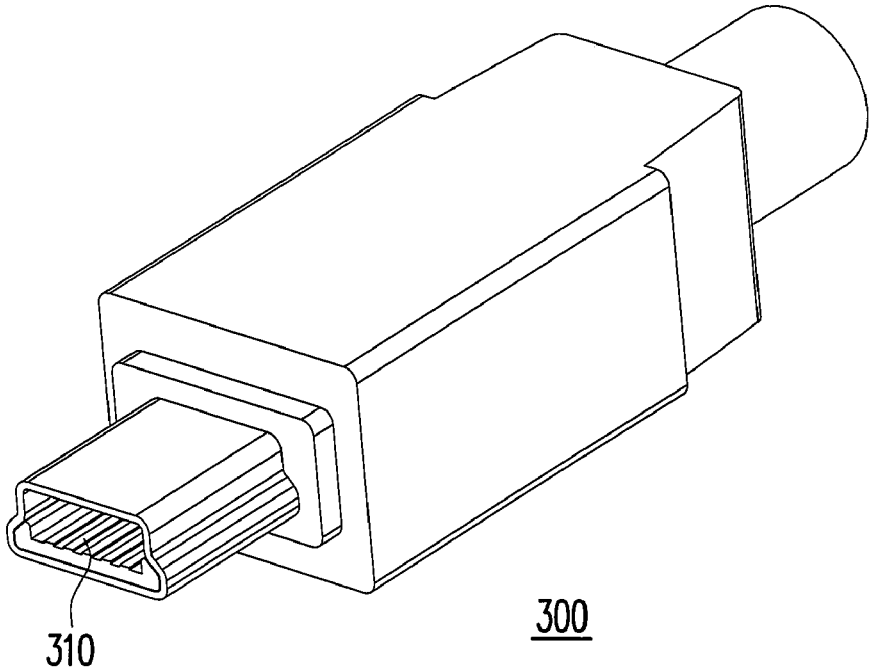
FIG. 3 (PRIOR ART)

FIG. 2 and FIG. 3 respectively illustrate conventional MINI A and MINI B male joint connectors. Referring to FIG. 2 and FIG. 3, the 5 USB terminals (or pins) 210 in FIG. 2 are disposed on the MINI A connector 200 and can be used for signal transmission, and the 5 USB terminals (or pins) 310 in FIG. 3 are disposed on the MINI. B connector 300, but the sizes and patterns of the interfaces are slightly different for preventing misplug or reverse plug, which may cause misjudgment or failure. Besides, the MINI A connector 200 and the MINI B connector 300 are only suitable for respective male joint or female joint since the MINI A connector 200 and the MINI B connector 300 are designed to be fool-proof.

Figure 4:
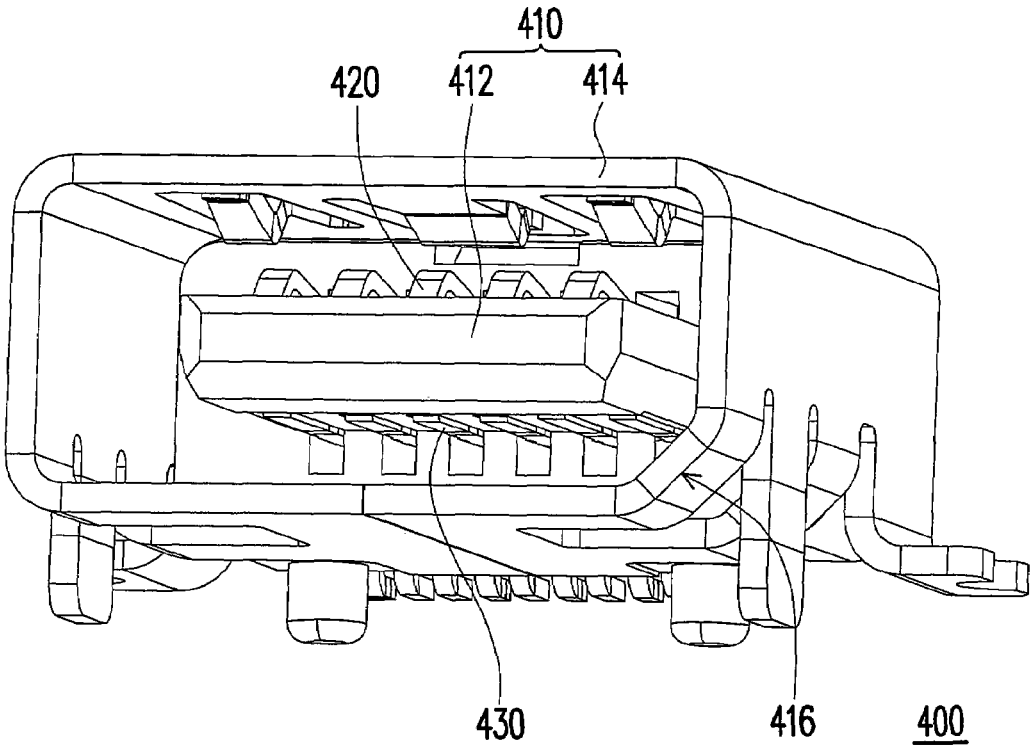
FIG. 4 is a diagram of a connector according to an embodiment of the present invention.
Figure 5:
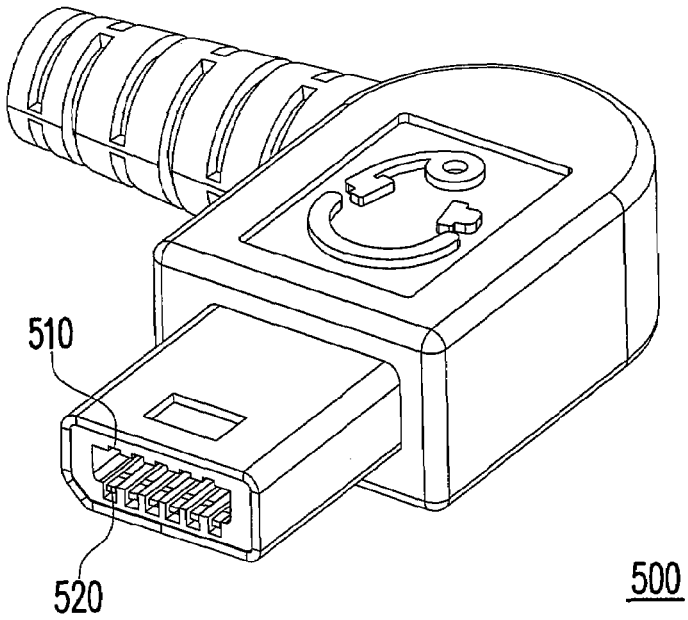
FIG. 5 illustrates a double-sided 11-pin male joint connector complying with USB specification which is suitable for the connector in FIG. 4.

FIG. 4 is a diagram of a connector 400 according to an embodiment of the present invention, and FIG. 5 illustrates a double-sided 11-pin male joint connector 500 complying with USB specification which is suitable for the connector in FIG. 4. Referring to FIG. 5, the difference of the connector 500 from the foregoing MINI A connector 200 and MINI B connector 300 is that the male joint connector 500 in FIG. 5 has 5 USB terminals (or pins) 510 located on the top surface of the interface and 6 USB terminals (or pins) 520 located on the bottom surface of the interface, and the total quantity of the terminals is 11. Wherein, the 5 USB terminals 510 on the top surface of the interface can be served as the first set of signal terminals, and the 6 USB terminals 520 on the bottom surface of the interface can be served as the second set of signal terminals. Since the quantity of the first set of signal terminals is the same as the quantity of the original MINI A or MINI B USB terminals, the first set of signal terminals can be used as the USB terminals of the original peripheral device and it is not necessary to change the circuit design thereof. The newly added second set of signal terminals can be used along with the first set of signal terminals as the USB terminals of the newly developed peripheral device for function expansion.

Referring to FIG. 4, to share the male joint having different USB terminals, the present invention provides a connector 400 including a base 410, a plurality of first pins 420, and a plurality of second pins 430. Wherein, the base 410 can be welded, or assembled to an electronic apparatus (not shown), and the slot of the base 410 is used for accommodating a male joint having similar size to the slot, for example the MINI A type connector 200 or the MINI B type connector 300 (first type joint), or the double-sided 11-pin male joint connector 500 (second type joint), so that the newly developed connector 400 can be suitable for different types of USB terminals.

As shown in FIG. 4, the base 410 includes a convex part 412 and a concave part 414 for accommodating the convex part 412, wherein a plurality of first pins 420 is disposed on the top surface of the convex part 412 and is arranged in a row to form a first connecting surface. Besides, a plurality of second pins 430 is disposed on the bottom surface of the convex part 412 and is arranged in a row to form a second connecting surface. The first connecting surface and the second connecting surface are stacked on two opposite surfaces. When the double-sided 11-pin male joint connector 500 is plugged into the slot formed by the convex part 412 and the concave part 414 of the base 410, the first pins 420 come into contact correspondingly with the terminals 510 at one side in the male joint connector 500 and are turned on, and the second pins 430 come into contact correspondingly with the terminals 520 at the other side in the male joint connector 500 and are turned on. If the MINI A connector 200 or the MINI B connector 300 is plugged into the slot of the base 410, only the first pins 420 come into contact correspondingly with the terminals of the connector 200 or 300 to be turned on while the second pins 430 are left unused. Accordingly, the quantity of the first pins 420 complies with the pin quantity specified for MINI A or MINI B USB, and the total quantity of the first pins 420 and the second pins 430 complies with the pin quantity specified for double-sided 11-pin USB, that is, the total quantity of the first pins 420 is 5, and the total quantity of the second pins 430 is 6, and the total pin quantity of the second joint (double-sided 11-pin USB) is greater than the total pin quantity of the first joint (MINI A or MINI B USB). Certainly, even though the quantities of the first pins 420 and the second pins 430 are explained in the present embodiment as example, they are not limited thereto.

Figure 6A:
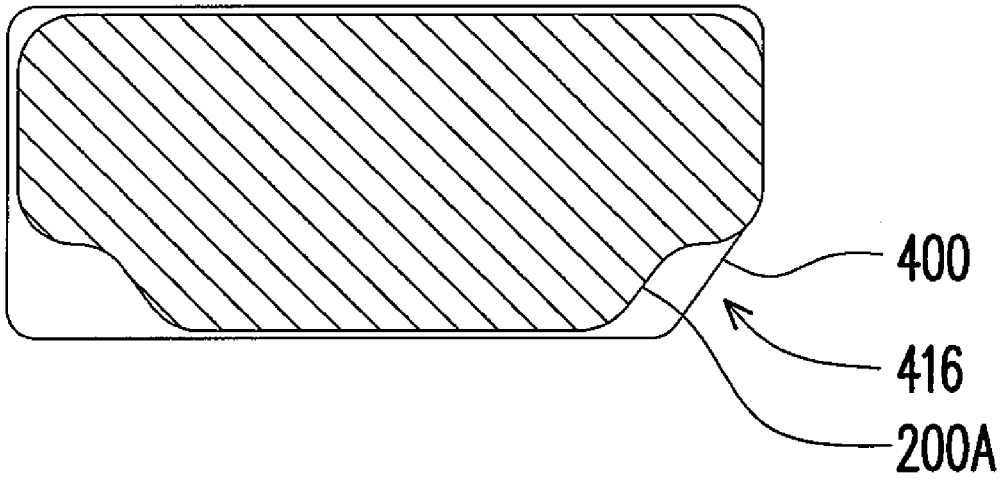
FIG. 6A and FIG. 6B are diagrams illustrating the front plug-in of a male joint and a female joint.
Figure 6B:
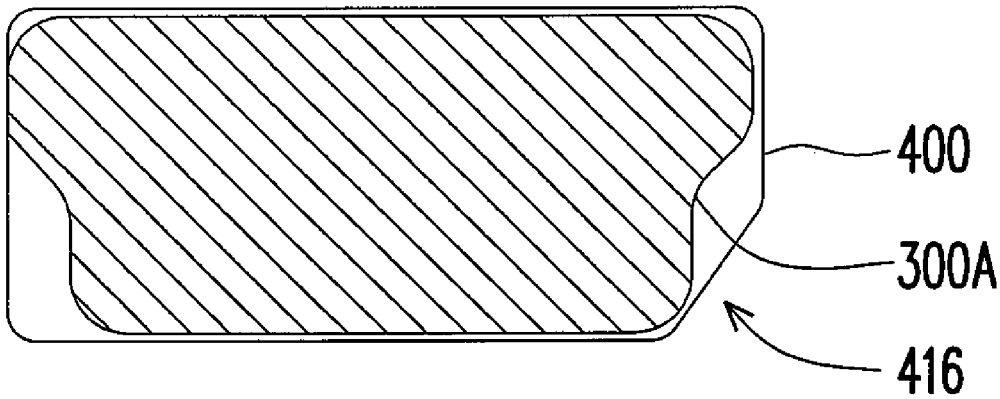
Figure 7A:
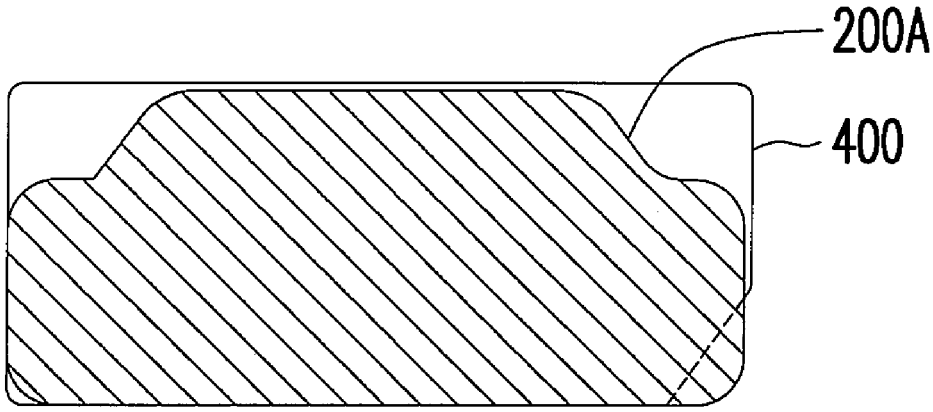
FIG. 7A and FIG. 7B are diagrams illustrating the back plug-in of a male joint and a female joint.
Figure 7B:
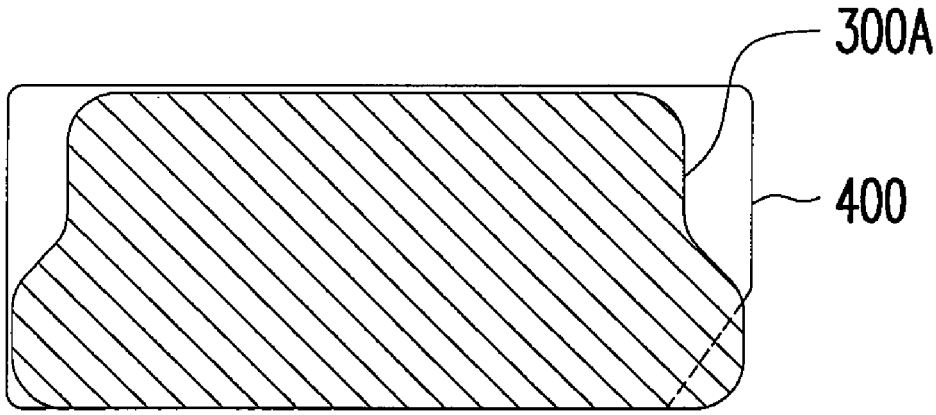

Refer to FIG. 6A and FIG. 6B, which are diagrams illustrating the correct plug-in of a male joint and a female joint, and FIG. 7A and FIG. 7B, which are diagrams illustrating the reverse plug-in of a male joint and a female joint. In the present embodiment, to prevent the MINI A male joint 200A or the MINI B male joint 300A from mistakenly contacting the second pins 430 of the connector 400 when the MINI A male joint 200A or the MINI B male joint 300A is plugged in reversely, the pattern of the connector 400 is designed to be fool-proof, that is, a concave edge portion 416 is designed for avoiding device failure or misjudgment. The MINI A male joint 200A in FIG. 6A and the MINI B male joint 300A in FIG. 6B can be correctly plugged into the double-sided 11-pin female joint connector 400, however, they cannot be reversely plugged into the double-sided 11-pin female joint connector 400 due to size prevention, as shown in FIG. 7A and FIG. 7B, so that the purpose of fool-proof can be achieved.

Figure 8A:
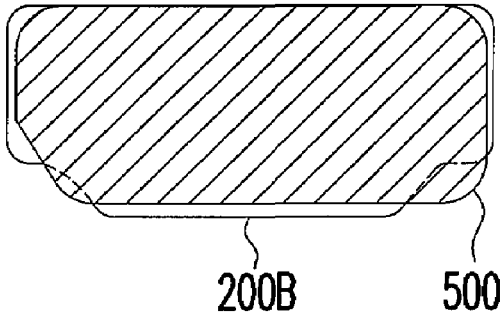
FIGS. 8A~8C are diagrams illustrating fool-proof when the male joint in the present invention is not suitable for the original MINI A, MINI B, and MINI AB female joints.
Figure 8B:
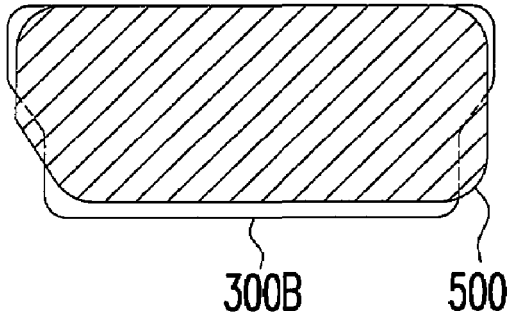
Figure 8C:
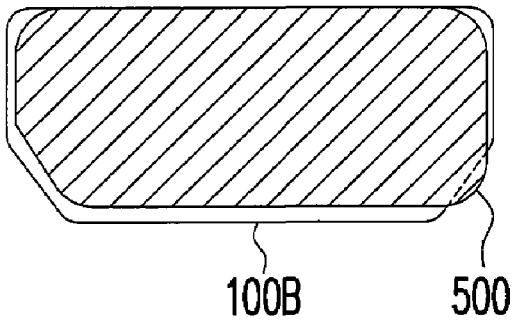

Next, refer to FIGS. 8A-8C, which are diagrams illustrating fool-proof when the double-sided 11-pin male joint connector 500 in the present invention is not suitable for the original MINI A, MINI B, and MINI AB female joints. To prevent the newly developed male joint 500 from being mistakenly plugged into the original female joint 200B, 300B, or 100B, the pattern of the male joint 500 is purposely designed different from the original female joints, so that the newly developed male joint 500 cannot be plugged into the original host, accordingly the male joint 500 is prevented from being turned on mistakenly and the purpose of fool-proof is achieved.

As described above, in the present invention, the connectors 400 and 500 keep the functions of the original 5-pin USB interface to be used by the original 5-pin MINI A and MINI B peripheral devices, and the USB interface of the newly added 6 pins is for function expansion so that the connector 400 can be used by the newly developed peripheral device, that is, the total quantity of the first pins and the newly added second pins can be used by the second kind of peripheral device having higher pin quantity.

Since the newly added second pins 430 are disposed with at least one identification pin, the type of the second joint can be determined based on the voltage variations of the first identification voltage and the second identification voltage, that is, the pre-classified second joint is determined based on the configuration of short circuit status, impedance status, and open circuit status between the two wires for connecting the host and the second joint. In addition, the newly added second pins 430 can be further disposed a ground pin corresponding to the ground terminal of the second joint to produce a common ground terminal. Moreover, when the second joint is connected to an audio signal receiver, for example, earphone, speaker, microphone, or other multimedia electronic devices, the second pins are also disposed with at least one audio pin to transmit audio signals. The foregoing identification pin, ground pin, and audio pin can be arranged and combined based on the circuit design and will not be described in detail herein.

In overview, according to the present invention, a connector structure compatible to typical MINI A and MINI B USB interfaces is adopted, and a set of independent functional pins are added to the original connector structure so that the first and the second joints having different pin quantities can both use the highly compatible connector structure. Thus, the connector of the present invention can meet function expansion requirement and furthermore, the purpose of connector sharing in product design can be accomplished.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A compatible connector for a first and a second joint having different pin quantities, comprising:

a base, comprising a first connecting surface and a second connecting surface;

at least one first pin, disposed on the first connecting surface, the quantity of the first pins being the same as the pin quantity of the first joint; and at least one second pin, disposed on the second connecting surface, the total quantity of the second pins and the first pins being the same as the pin quantity of the second joint.

2. The connector as claimed in claim 1, wherein the base comprises:

a convex part, wherein the first connecting surface and the second connecting surface are respectively disposed on two opposite surfaces of the convex part; and a concave part, accommodating the convex part.

3. The connector as claimed in claim 2, wherein the base further comprises a concave edge portion disposed at a corner of the concave part to form a fool-proof structure.

4. The connector as claimed in claim 2, wherein a slot is disposed between the convex part and the concave part for accommodating the first joint or the second joint.

5. The connector as claimed in claim 1, wherein the first joint comprises a joint complying with the specification of MINI A or MINI B USB (universal serial bus).

6. The connector as claimed in claim 1, wherein the second joint comprises an 11-pin joint complying with the USB (universal serial bus) specification.

7. The connector as claimed in claim 1, wherein the quantity of the first pins comprises the quantity of the pins complying with the specification of MINI A or MINI B USB (universal serial bus).

8. The connector as claimed in claim 1, wherein the total quantity of the second pins and the first pins is 11, and the quantity of the first pins is 5, and the quantity of the second pins is 6.

9. The connector as claimed in claim 1, wherein the at least one second pin includes two identification pins, and the second joint is determined based on a voltage between the two identification pins.

* * * * *